US005293701A

United States Patent [19]

Sullivan

[11] Patent Number: 5,293,701

[45] Date of Patent: Mar. 15, 1994

[54] CONVERTIBLE FOOTWEAR

[76] Inventor: William W. Sullivan, 17 Old Oak Ave., Westminster, Mass. 01473

[21] Appl. No.: 495,155

[22] Filed: Mar. 19, 1990

[51] Int. Cl.[5] ..... A43B 23/28; A43C 15/00

[52] U.S. Cl. ..... 36/59 R; 36/114; 36/67 D; 36/59 A

[58] Field of Search ..... 36/126, 127, 114, 132, 36/134, 128, 67 D, 129, 59 A, 59 R

[56] References Cited

U.S. PATENT DOCUMENTS

| | | | |
|---|---|---|---|
| 3,281,971 | 11/1966 | Weitzner | 36/59 R |
| 3,444,630 | 5/1969 | Morelli | 36/134 X |
| 3,793,750 | 2/1974 | Bowerman | 36/129 X |
| 3,812,605 | 5/1974 | Kaestle | 36/67 D |
| 3,844,056 | 10/1974 | Kwan | 36/67 D |
| 3,859,739 | 1/1975 | Dassler | 36/67 D |
| 4,194,310 | 3/1980 | Bowerman | 36/59 R X |
| 4,262,434 | 4/1981 | Michelotti | 36/67 D |
| 4,299,038 | 11/1981 | Epple | 36/67 D |
| 4,318,232 | 3/1982 | Ching | 36/67 D X |
| 4,380,878 | 4/1983 | Skaja | 36/67 D |
| 4,631,842 | 12/1986 | Koskela | 36/59 R X |
| 4,782,604 | 11/1988 | Wen-Shown | 36/127 |

FOREIGN PATENT DOCUMENTS

| | | | |
|---|---|---|---|
| 223894 | 8/1959 | Australia | 36/127 |
| 2717910 | 10/1978 | Fed. Rep. of Germany | 36/59 R |
| 2223394 | 4/1990 | United Kingdom | 36/127 |

*Primary Examiner*—Paul T. Sewell
*Assistant Examiner*—Beth Anne Cicconi
*Attorney, Agent, or Firm*—George E. Kersey

[57] ABSTRACT

Footwear which is adaptable for athletic events requiring different sole configurations for different playing surfaces, for example artificial turf and natural turf, by providing the soles of shoes with a prescribed pattern of protuberances which are suitable for one type of event, and altering the pattern to adapt the shoes for another and different type of event. In particular the sole of each shoe can have removable conical cleats for playing on natural turf, and removable stud or square cleats for playing on artificial turf.

7 Claims, 3 Drawing Sheets

FIG. 3
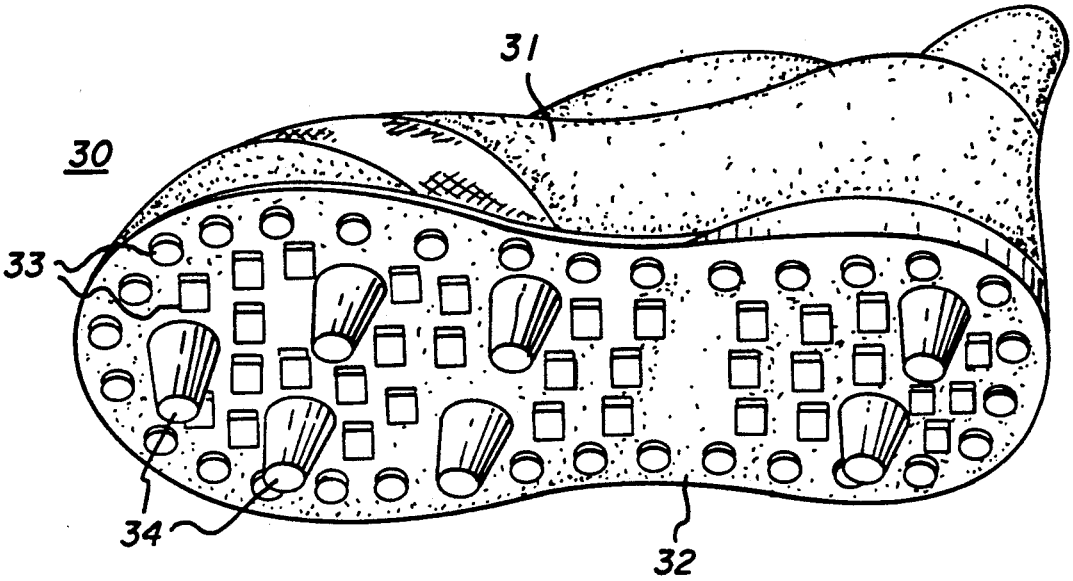
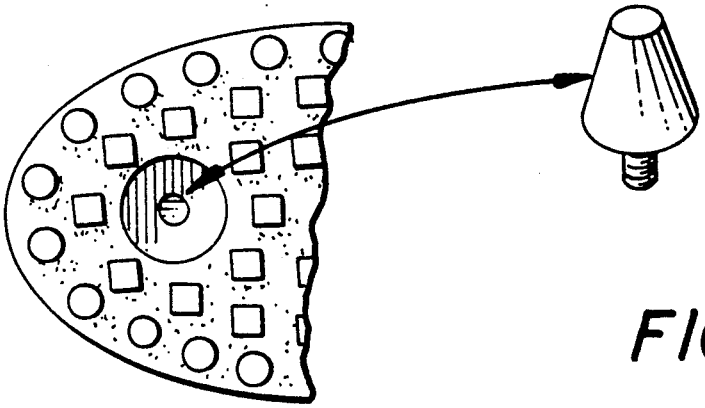
FIG. 4A
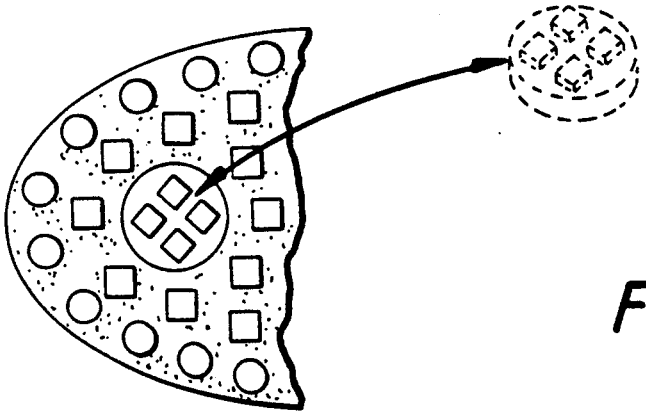
FIG. 4B

FIG. 5A
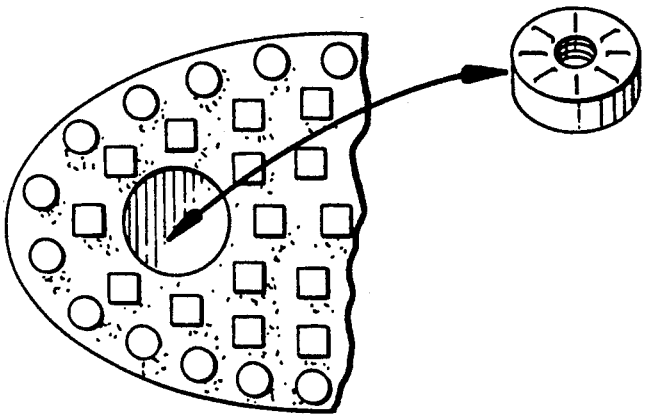
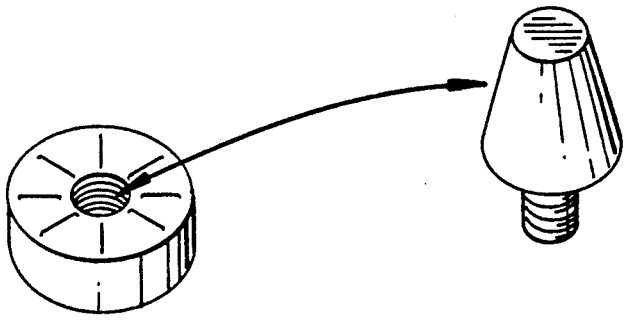
FIG. 5B

CONVERTIBLE FOOTWEAR

BACKGROUND OF THE INVENTION

This invention relates to foot wear, and more particularly, to special purpose footwear for athletic events.

Special purpose footwear for athletic events is designed taking into account, the particular circumstances associated with the event. For example, a football shoe for artificial turf of the kind commonly employed at indoor arenas has a different configuration than a football shoe for natural turf where blades of grass extend from sod and similar base materials. Artificial turf is formed by matting with projecting plastic blades which simulate grass.

Football shoes for artificial turf have soles with stubby projections positioned along interior contours with respect to the outer edge contour of the sole. In the typical shoe for artificial turf, the edge contour of the sole has positioned near it an interiorly a set of approximately 70 rectangular projections which are equally spaced from one another. On the further interior of the sole are larger, similar projections that constitute approximately three partial contours, each of which has a contour line similar to that of the sole edge but is interrupted at the position of the arch. The heel portion of the sole also includes two partial contours.

While this type of sole pattern has been found to suitable for artificial turf, it is unsuitable for natural turf.

Consequently, an entirely different shoe with a different sole pattern has been required. In particular, the typical football shoe for natural turf includes a sole with five conical projections, known as "cleats" that extend from the sole portion of the shoe near the edge contour for the sole and two conical projections or cleats extending from near the heel.

In addition, the nature and type of cleat can depend upon climatic conditions at the time of the event and sometimes upon the personal preference of the player. Some players believe that a particular type of cleat will bring them good fortune.

The result is that a player on different kinds of turf, such as natural and artificial turf, often requires many different pairs of shoes.

Accordingly, it is an object of the invention to simplify the different kinds of footwear that are required for special purpose events, such as football contests.

Another object of the invention is to provide footwear that can easily be adapted to a wide variety of contests, such as those on natural and artificial turf. A related object is to eliminate the need for alternative kinds of footwear in order to achieve satisfactory performance on a wide variety of playing surfaces.

SUMMARY OF THE INVENTION

In accomplishing the foregoing and related objects, the invention provides adaptable wear formed by a cover and an attached base. The base bears a prescribed pattern adapted to a special purpose, and alterable to adapt the base to a different purpose. The cover can be for a foot attached to a sole bearing a prescribed pattern for a particular event. The pattern of the sole can be altered to adapt the footwear to a different event.

In accordance with one aspect of the invention, the prescribed pattern can be for athletic events on artificial turf and be alterable to adapt the base to athletic events on natural turf.

The base can be a sole with an outer edge contour. The prescribed pattern for artificial turf is then a set of quadrilateral protuberances which are disposed along an interior contour in alignment with the outer edge. The pattern is altered by adding a plurality of cleats that project from the base.

The cleats are temporarily attachable to the sole and are removable and replacable to adapt the footwear to a different kind of turf. The cleats are insertable into the base along an interior contour at prescribed positions that contain receptacles for the cleats, such as threaded recesses.

In accordance with another aspect of the invention each receptacle can be occupied by an insert which completes the original pattern on the sole. The positions containing the receptacles can be formed by removable plugs inserted into the base of the sole. Inserts can be positioned in the removable plugs for completing the pattern of the sole.

In accordance with still another aspect of the invention, the cleats are conical projections of prescribed length. The cleats are interchangeable with other conical projections as desired by the user.

In a method of adapting wear to a particular set of events an item is provided with a prescribed pattern intended for a particular event. The pattern is then modified to adapt the item for use in an alternative event.

The pattern can include removable elements so that selected ones of the elements can be removed and alternative elements substituted which are adapted to the alternative event.

When the item of wear includes a sole, cleats can be inserted into the sole to adapt the item for an alternative event. The cleats can be threaded into the sole and removed by rotating the conical bodies of the cleats to free their threaded end portions from the base.

In a method of manufacturing wear adaptable to different events, a cover is attached to a base that bears a prescribed pattern and is adaptable to provide an alternative pattern. The base can bear a prescribed pattern for artificial turf and be adaptable to an alternative pattern for natural turf. The prescribed pattern for natural turf can be a set of quadrilateral protuberances disposed along a contour interior of and similar to the contour at the edge of the base. The alternative pattern is provided by a set of conical protuberances that are attachable to the base to supplement the prescribed pattern.

DESCRIPTION OF THE DRAWINGS

Other aspects of the invention will become apparent after considering several illustrative embodiments, taken in conjunction with the drawings in which:

FIG. 3 is a perspective view of a football shoe adapted in accordance with the invention for use on both artificial and natural turf;

FIG. 4A is a diagram of a portion of the sole for the shoe of FIG. 3 with a removed cleat;

FIG. 4B is a diagram in accordance with FIG. 4A in which a plug has been inserted in order to restore the original pattern of the sole for artificial turf;

FIG. 5A is a diagram of an alternative mounting insert for adapting footwear for use in alternative events pursuant to the invention; and FIG. 5B is a diagram showing the attachment of a cleat to the mounting insert of FIG. 5A.

DETAILED DESCRIPTION

Figure 1:
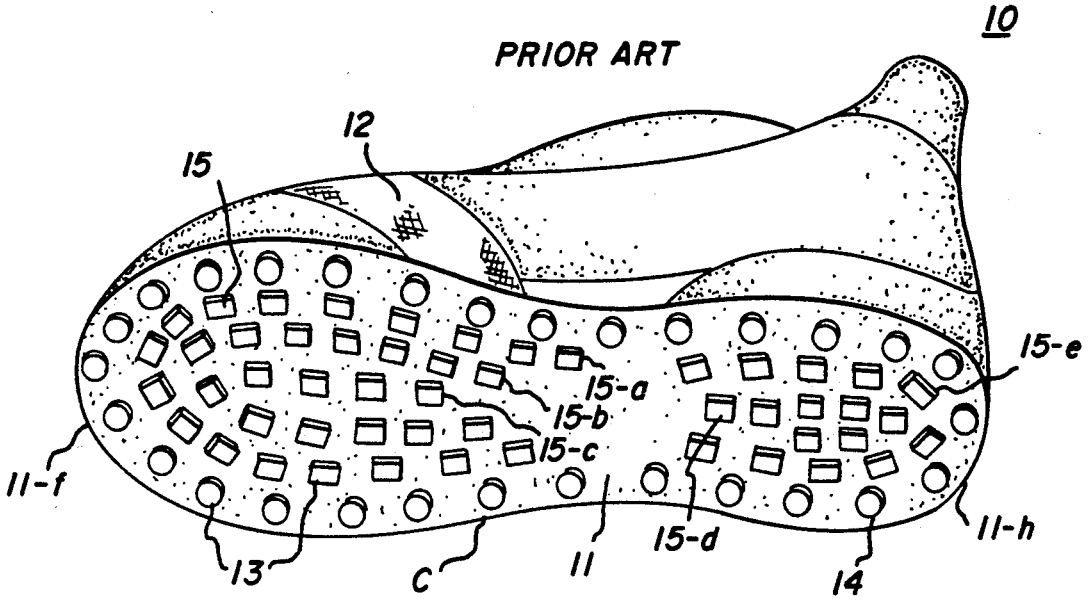
FIG. 1 PRIOR ART
FIG. 1 is a perspective view of a football shoe with a sole pattern for artificial turf.

With reference to the drawings, FIG. 1 shows an item 10 of footwear in which a sole 11 is attached to a cover 12. The sole 11 bears a prescribed pattern of quadilateral protuberances 13 which are specially designed for contacting artificial turf.

Since artificial turf uses a base mat with projecting blades, suitable contact is made by having a relatively large number of quadilateral protuberances 13 with limited depth with respect to the sole 11.

In particular, the sole 11 has an edge contour C with a forward portion 11-*f* and a rearward heel portion 11-*h*. Along the interior of the sole, near the edge C, there is a first set 14 of quadilateral protuberances which are shallower than the interior protuberances 15. The latter are in two partial patterns which are separated at the arch A.

The sole pattern on the frontal portion 11-*f* has three contours 15-*a*, 15-*b* and 15-*c* of protuberances 15, while the rearward heel portion 11-*h* has only two partial contours 15-*d* and 15-*e* of protuberances 15. The interior protuberances 15 are of equal height and the interval between adjoining protuberances along the interior contour lines is approximately the same as the length of each protuberance.

Figure 2:
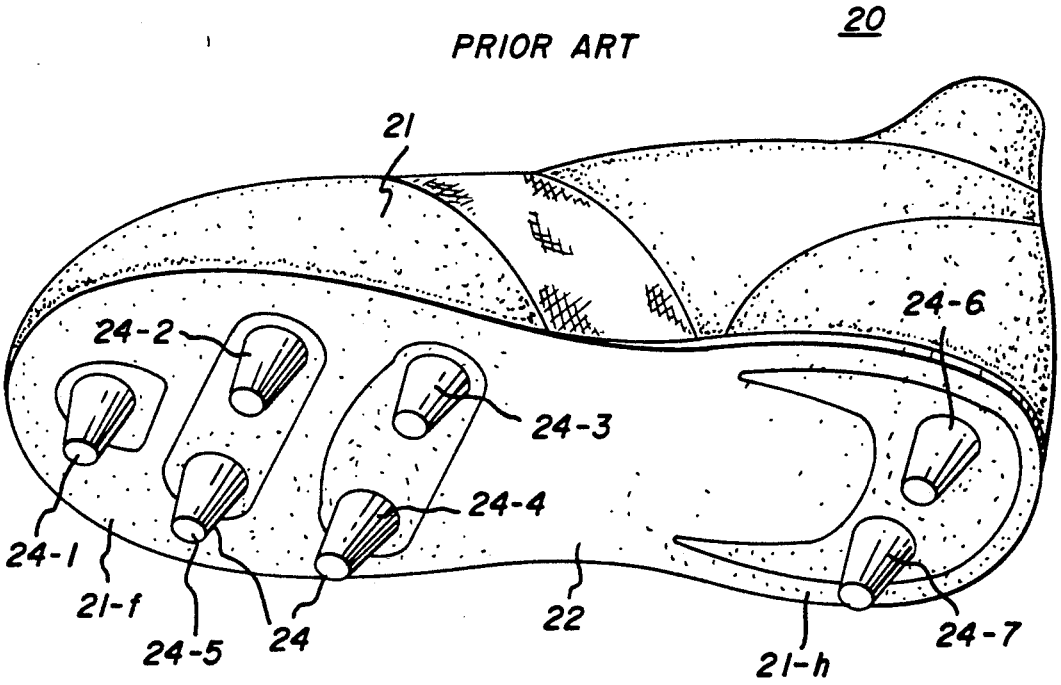
FIG. 2 PRIOR ART
FIG. 2 is a perspective view of a different football shoe with a sole pattern for natural turf.

By contrast, as indicated in FIG. 2, a football shoe 20 for natural turf includes a cover 21 attached to a sole 22 with cleats 24 of which the frontal sole portion 21-*f* includes five cleats 24-1 through 24-5 and the rear heel portion 21-*h* includes only two cleats 24-6 and 24-7.

When a player has a game on natural turf, he uses the shoe of FIG. 2, but he must changed his shoe when the game is on artificial turf in order to present a sole contacting pattern for the kind of shoe shown in FIG. 1.

In order to limit the extent to which footwear must be changed and modified for various athletic events, the invention provides the kind of shoe 30 shown in FIG. 3 in which the sole 32 bears patterns 33 and 34 corresponding respectively to the protuberances of FIG. 1 and the cleats of FIG. 2.

When the shoe 30 is to be used on artificial turf, the cleats can be unthreaded from their mounts and the shoe used directly, or an insert can be substituted for the cleat in order to complete the prior pattern that is specially adapted for artificial turf.

The sole 31 can be fabricated with the protuberance pattern for artificial turf and the mounts for the cleats, or the mounts can be applied to the sole as inserts which receive either a cleat or a completion protuberance pattern, depending upon the use that is to be made of the footwear.

I claim:

1. The method of converting footwear which comprises the steps of:

(a) providing an item of footwear bearing a prescribed surface contacting pattern of elements intended for use in a special athletic event; and (b) modifying said pattern with elements of different configuration to adapt said item of footwear of use in an alternative athletic event;

wherein said pattern includes removable elements of a first king and further including the step of removing selected ones of said elements and substituting alternative elements of a second and different kind which are adapted to said alternative event.

2. The method of claim 1 wherein said item of wear includes a sole and further including the step of inserting cleats into said sole between adjoining elements of a different kind to adapt said item of war for said alternative event.

3. The method of claim 1 including the step of threading said cleats with conical bodies into said sole using hand threaded members.

4. The method of claim 2 including the step of removing said elements of said first king by rotating their bodies by hand to remove their threaded end portions from said base.

5. Convertible footwear comprising a cover with a base attached thereto; said base having an outer edge and a prescribed surface contacting pattern adapted to a special athletic event; and means for altering said pattern to include a different surface contacting pattern to adapt said base for a different athletic event;

wherein said prescribed pattern is for athletic events on artificial turf comprises a set of quadrilateral protuberances which are disposed along an interior contour in alignment with said outer edge, and said altering means interrupt said pattern, adapts said base to athletic events on natural turf and comprises a plurality of cleats projecting from said base above the height of said quadrilateral protuberances in order to be suitable for natural turf; and said cleats are insertable into said base along an interior contour containing a plurality of said protuberances between each of said cleats at prescribed positions containing means for receiving said cleats, with each receiving means occupied by an insert which completes the original protuberance pattern on said base.

6. Convertible footwear comprising a cover with a base attached thereto; said base having an outer edge and a prescribed surface contacting pattern adapted to a special athletic event; and means for altering said pattern to include a different surface contacting pattern to adapt said base for a different athletic event;

wherein said prescribed pattern is for athletic events on artificial turf and comprises a set of quadrilateral protuberances which are disposed along an interior contour in alignment with said outer edge, and said altering means interrupt said pattern, adapts said base to athletic events on natural turf and comprises a plurality of cleats projecting from said base above the height of said quadrilateral protuberances in order to be suitable for natural turf; and said cleats are insertable into said base along an interior contour containing a plurality of said protuberances between each of said cleats at prescribed positions containing means for receiving said cleats, with some of said positions containing removable circular plugs which are inserted into the base of said sole.

7. Wear as defined in claim 6 further including prior pattern means for insertion into said removable plugs for continuing the prior protuberance pattern of said sole.

* * * * *